United States Patent [19]

Adaniya et al.

[11] 4,325,790

[45] Apr. 20, 1982

[54] PROCESS FOR MANUFACTURING ELECTRO-GALVANIZED STEEL STRIP

[75] Inventors: Takeshi Adaniya; Masaru Ohmura, both of Fukuyama, Japan

[73] Assignee: Nippon Kokan Kabushiki Kaisha, Tokyo, Japan

[21] Appl. No.: 231,131

[22] Filed: Feb. 3, 1981

[30] Foreign Application Priority Data

Feb. 22, 1980 [JP] Japan ..... 55-20632

[51] Int. Cl.[3] ..... C25D 3/56; C25D 5/08; C25D 7/06; C25D 21/10

[52] U.S. Cl. ..... 204/27; 204/43 Z; 204/273; 204/275

[58] Field of Search ..... 204/27, 43 Z, 28, 273, 204/275

[56] References Cited

U.S. PATENT DOCUMENTS 4,048,381 9/1977 Adaniya ..... 204/43 Z
4,252,866 2/1981 Matsudo ..... 204/43 Z
4,272,334 6/1981 Fukuda ..... 204/27

FOREIGN PATENT DOCUMENTS 47-1652272 5/1972 Japan .
49-1997974 5/1974 Japan .
51-8383876 7/1976 Japan .
2046790 2/1980 United Kingdom ..... 204/43 Z

*Primary Examiner*—T. Tufariello
*Attorney, Agent, or Firm*—Frishauf, Holtz, Goodman & Woodward

[57] ABSTRACT

In a process for manufacturing an electro-galvanized steel strip, which comprises: moving a steel strip in an acidic electro-galvanizing bath containing cobalt and chrominum in parallel with the plane of at least one anode plate to subject said steel strip to an electro-galvanizing treatment, thereby forming, on at least one surface of said steel strip, an electro-galvanized layer excellent in bare corrosion resistance and corrosion resistance after chromating; the improvement characterized by: keeping the cobalt content in said electro-galvanizing bath within the range of from 8 to 30 g/l, as converted into metallic cobalt, the chromium content in said electro-galvanizing bath within the range of from 0.1 to 1.5 g/l, as converted into metallic chromium, and the temperature of said electro-galvanizing bath within the range of from 35° to 60° C.; and, flowing said electro-galvanizing bath between said steel strip and said anode plate at a flow velocity of at least 0.35 m/sec in a direction at right angles to the travelling direction of said steel strip.

1 Claim, 7 Drawing Figures

PROCESS FOR MANUFACTURING ELECTRO-GALVANIZED STEEL STRIP

REFERENCE TO PATENTS, APPLICATIONS AND PUBLICATIONS PERTINENT TO THE INVENTION

As far as we know, there are available the following prior documents pertinent to the present invention:

(1) Japanese Patent Publication No. 16,522/72 dated May 16, 1972;

(2) Japanese Patent Publication No. 19,979/74 dated May 21, 1974; and, (3) Japanese Patent Provisional Publication No, 83,838/76 dated July 22, 1976.

FIELD OF THE INVENTION

The present invention relates to a process for manufacturing an electro-galvanized steel strip and more specifically for forming, on a steel strip, by subjecting said steel strip to an electro-galvanizing treatment in an acidic electro-galvanizing bath containing cobalt (hereinafter written as "Co") and chromium (hereinafter written as "Cr"), an externally uniform electro-galvanized layer showing a stable corrosion resistance of the electro-galvanized layer itself (hereinafter referred to as "bare corrosion resistance") and an excellent corrosion resistance after chromating treatment.

BACKGROUND OF THE INVENTION

In general, an electro-galvanized steel sheet is widely used in such areas as home electrical appliances and automotive outer shell because of its excellent corrosion resistance.

Recently, however, there is an increasing demand from users and manufacturers of said electro-galvanized steel sheet for the improvement of corrosion resistance of the electro-galvanized layer of an electro-galvanized steel sheet with a view to simplifying the manufacturing process of electro-galvanized steel sheets, saving zinc resources, and reducing the manufacturing costs.

The following methods are known as those for improving bare corrosion resistance of an electro-galvanized steel sheet with a view to improve a corrosion resistance of an electro-galvanized steel sheet:

(1) An acidic electro-galvanizing process, disclosed in Japanese Patent Publication No. 16,522/72 dated May 16, 1972, which comprises:

(a) in an acid electro-galvanizing bath added with from 5 to 50 g/l metallic Co in the form of at least one of water-soluble compounds of Co, subjecting a steel sheet to an electro-galvanizing treatment so that the electro-galvanizing layer contains Co compounds;

(b) in an acidic electro-galvanizing bath added with from 0.3 to 20 g/l metallic Co in the form of at least one of water-soluble compounds of Co and also added with at least one of water-soluble compounds of molybdenum, tungsten or iron, subjecting a steel sheet to an electro-galvanizing treatment so that the electro-galvanized layer contains compounds of said metals.

(2) A steel sheet serving as a substrate for coating disclosed in Japanese Patent Publication No. 19,979/74 dated May 21, 1974, which comprises:

(a) a metal layer formed on the surface of a steel sheet by an electro-galvanizing treatment, said layer containing Zn, as the main constituent, and at least one of Mo, W and Co, as the sub-constituent, in an amount of from 0.05 to 7 wt.% as at least one of metallic Mo, W and Co relative to the total weight of the electro-galvanized layer in the form of at least one of the oxides of Mo, W or Co;

(b) a metal layer formed on the surface of the steel sheet by an electro-galvanized treatment, said layer containing Zn, as the main constituent, and at least one of Mo, W and Co, as the sub-constituent, in an amount of from 0.05 to 7 wt.% as at least one of metallic Mo, W and Co relative to the total weight of the electro-galvanized layer in the form of at least one of the oxides of Mo, W or Co, and also containing at least one of Fe, Ni, Sn, and Pb, as the further sub-constituent, in an amount of from 0.5 to 15 wt.% as at least one of metallic Fe, Ni, Sn and Pb relative to the total weight of the electro-galvanized layer in the form of at least one of metals or compounds of Fe, Ni, Sn or Pb.

According to the above-mentioned prior arts (1) and (2), it is possible to improve bare corrosion resistance as compared with that of the pure-zinc galvanized steel sheet.

However, in view of the recent demand for an electro-galvanized steel sheet further excellent in bare corrosion resistance, the electro-galvanized steel sheets based on the prior arts disclosed in the above-mentioned prior arts are still insufficient in some cases in bare corrosion resistance. In addition, when the electro-galvanized layer is subjected to a chromating treatment according to the above-mentioned prior arts (1) and (2), corrosion resistance after chromating has been inferior because of the insufficient weight of chromium deposited onto the surface of the electro-galvanized steel sheet.

Therefore, the present inventors proposed previously the following method, with a view to solving the problems involved in the above-mentioned prior arts (1) and (2):

(3) A method for manufacturing a chromated electro-galvanized steel sheet, disclosed in Japanese Patent Provisional Publication No. 83,838/76 July 22, 1976, which comprises:

in an acidic electro-galvanizing bath principally comprising Zn ion, and containing:

at least one additive selected from the group consisting of:

(a) $Cr^{6+}$: from 50 to 700 ppm, (b) $Cr^{3+}$: from 50 to 500 ppm, (c) $Cr^{3+}$ and $Cr^{6+}$: from 50 to 700 ppm, $Cr^{6+}$ being up to 500 ppm, (d) In ion: from 10 to 3,000 ppm, and (e) Zn ion: from 10 to 25,000 ppm, and further containing:

(f) Co ion: from 50 to 10,000 ppm;

subjecting a steel sheet to an electro-galvanizing treatment to form a first galvanized layer on the surface thereof; and then, subjecting said electro-galvanized steel sheet having said first galvanized layer thus formed to an ordinary chromating treatment.

It is sure that, according to the above-mentioned method, bare corrosion resistance of an electro-galvanized steel sheet is improved over those of the prior arts (1) and (2) previously described, and at the same time, corrosion resistance after chromating treatment is remarkably improved.

In the method of the above item (3), however, when changing the galvanizing current density so as to meet a change of the line speed or other conditions, the Co content of the electro-galvanized layer also changed, and it was impossible to obtain an electro-galvanized steel sheet having an electro-galvanized layer which has a uniform external appearance and was excellent in bare corrosion resistance.

FIG. 1 illustrates the relationship between the galvanizing current density when subjecting a steel sheet to an electro-galvanizing treatment and the Co content of the electro-galvanized layer.

The test conditions for this were as follows:

(a) Chemical composition of the acidic electro-galvanizing bath employed:

$ZnSO_4/7H_2O$ (zinc sulfate): 500 l g/l,
$Na_2SO_4$ (sodium sulfate): 50 g/l,
$CH_3COONa$ (sodium acetate): 12 g/l,
$CoSO_4$ (cobalt sulfate): 10 g/l, as converted into metallic Co,
$CrSO_4$ (chromium sulfate): 0.5 g/l, as converted into metallic Cr;

(b) Electro-galvanizing conditions:

Bath flow velocity between electrodes: (0.25 m/sec,
Bath temperature: 50° C.,
pH value: 4.0, and
Target weight of galvanized layer: 40 g/m$^2$.

As is clear from FIG. 1, a change of the galvanizing current density causes a large change of the Co content of the electro-galvanized layer.

For this reason, there is a demand for a method for manufacturing an electro-galvanized steel strip, capable of forming an electro-galvanized layer of which the external appearance does not become irregular even at a change of the galvanizing current density and which shows a stable bare corrosion resistance and is excellent in corrosion resistance after chromating treatment. However, such a method has not yet been proposed.

SUMMARY OF THE INVENTION

An object of the present invention is therefore to provide a process for manufacturing an electro-galvanized steel strip, which permits forming an electro-galvanized layer of which the Co content remains constant and the external appearance does not become irregular even at a change of the electro-galvanizing conditions such as the galvanizing current density, and which shows a stable bare corrosion resistance and is excellent in corrosion resistance after chromating.

In accordance with one of the features of the present invention, there is provided a process for manufacturing an electro-galvanized steel strip, in said process which comprises:

moving a steel strip in an acidic electro-galvanizing bath containing cobalt and chromium in parallel with the plane of at least one anode plate to subject said steel strip to an electro-galvanizing treatment, thereby forming, on at least one surface of said steel strip, an electro-galvanized layer excellent in bare corrosion resistance and corrosion resistance after chromating;

the improvement characterized by:

Keeping the cobalt content in said electro-galvanizing bath within the range of from 8 to 30 g/l, as converted into metallic cobalt, the chromium content in said electro-galvanizing bath within the range of from 0.1 to 1.5 g/l, as converted into metallic chromium, and the temperature of said electro-galvanizing bath within the range of from 35° to 60° C.;

and, flowing said electro-galvanizing bath between said steel strip and said anode plate at a flow velocity of at least 0.35 m/sec in a direction at right angles to the travelling direction of said steel strip.

DETAILED DESCRIPTION OF PREFERRED EMBODIMENTS

Figure 1:
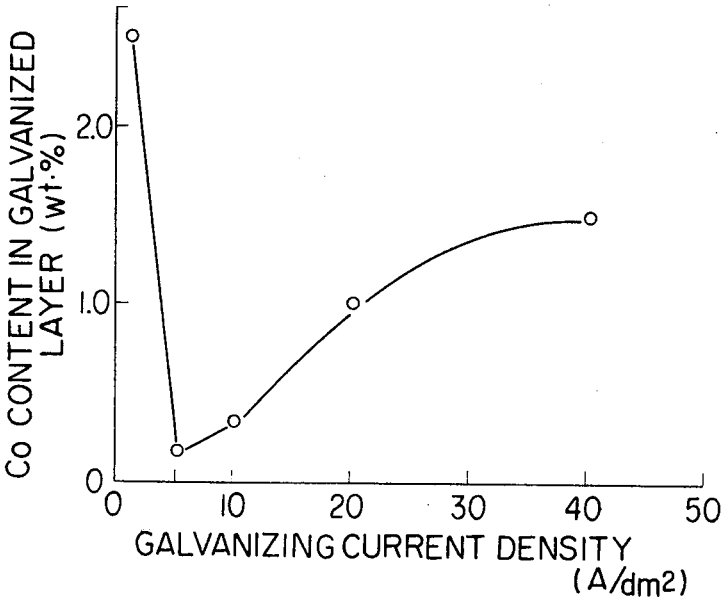
FIG. 1 is a drawing illustrating the relationship between the galvanizing current density and the Co content of the electro-galvanized layer.

We carried out extensive studies with a view to obtaining a process for manufacturing an electro-galvanized steel strip, which permits forming an electro-galvanized layer of which the Co content remains constant and the external appearance does not become irregular even at a change of the electro-galvanizing conditions such as the galvanizing current density, and which shows a stable bare corrosion resistance and is excellent in corrosion resistance after chromating treatment. As a result, we developed a process for manufacturing an electro-galvanized steel strip sufficiently provided with the above-mentioned characteristics.

The process for manufacturing an electro-galvanized steel strip of the present invention is:

in a process for manufacturing an electro-galvanized steel strip, which comprises:

moving a steel strip in an acidic electro-galvanizing bath containing cobalt and chromium in parallel with the plane of at least one anode plate to subject said steel strip to an electro-galvanizing treatment, thereby forming, on at least one surface of said steel strip, an electro-galvanized layer excellent in bare corrosion resistance and corrosion resistance after chromating;

the improvement characterized by:

keeping the cobalt content in said electro-galvanizing bath within the range of from 8 to 30 g/l, as converted into metallic cobalt, the chromium content in said electro-galvanizing bath within the range of from 0.1 to 1.5 g/l, as converted into metallic chromium, and the temperature of said electro-galvanizing bath within the range of from 35° to 60° C.;

and, flowing said electro-galvanizing bath between said steel strip and said anode plate at a flow velocity of at least 0.35 m/sec in a direction at right angles to the travelling direction of said steel strip.

The electro-galvanizing bath used in the present invention may be based on the conventional acidic electrogalvanizing bath. More specifically, zinc sulfate ($ZnSO_4.7H_2O$) or zinc chloride ($ZnCl_2$) is used as the main Zn source, with ammonium chloride ($NH_4Cl$) or other ammonium salt ($NH_4X$) as the conductive assistant, and sodium acetate ($CH_3COONa$) or sodium succinate ($(CH_2COONa)_2.6H_2O$) as the pH buffer. For example, an acidic electro-galvanizing bath, containing 440 g/l $ZnSO_4.7H_2O$, 90 g/l $ZnCl_2$, 12 g/l $NH_4Cl$, and 12 g/l ($(CH_2COONa)_2.6H_2O$ and having a pH value of about 4, may be directly used as the base of the electro-galvanizing bath of the present invention without applying any special treatment thereto.

In the present invention, the range of the galvanizing current density is not specifically defined, whereas, in order to conduct a high-speed electro-galvanizing treatment, it is desirable to use a current density of at least 10 $A/dm^2$.

Now, the reasons why the temperature and the flow velocity of the electro-galvanizing bath are defined as mentioned above, the effects of the above-mentioned constituents added to the electro-galvanizing bath, and the reasons why the amounts of these constituents are defined as mentioned above, are described below.

(1) Flow velocity of electro-galvanizing bath:

We investigated the relationship between electro-galvanizing conditions and the Co content of the electro-galvanized layer. According to the result of this investigation, the Co content of the electro-galvanized layer hardly varies with the change of the pH value of the electro-galvanizing bath, but is kept almost constant, whereas it varies largely with the change of the flow velocity of the electro-galvanizing bath in the galvanizing tank, i.e., the change of the flow velocity of the electro-galvanizing bath flowing between at least one anode plate installed in the galvanizing tank and a steel strip travelling in parallel with the plane of the anode plate in a direction at right angles to the travelling direction of the steel strip.

Figure 2:
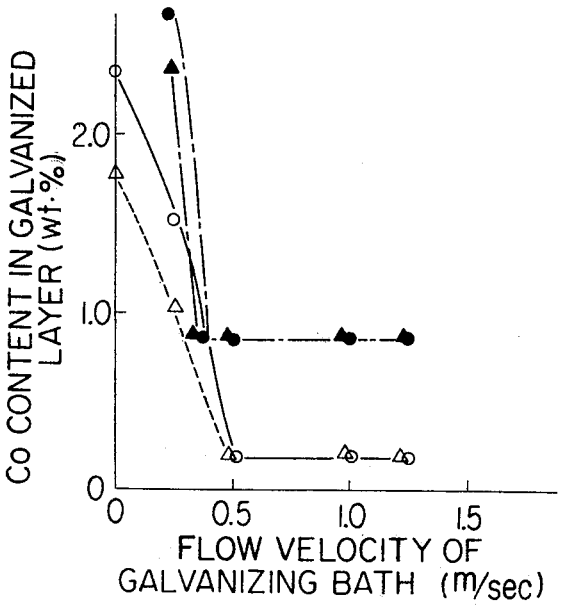
FIG. 2 is a drawing illustrating the relationship between the flow velocity of the electro-galvanizing bath and the Co content of the electro-galvanized layer.

FIG. 2 shows the relationship between the Co content of the electro-galvanized layer and the flow velocity of the electro-galvanizing bath. The flow velocity of the electro-galvanizing bath shown in FIG. 2 is the flow velocity of the electro-galvanizing bath flowing between a vertical pair of anode plates each of which is horizontally installed in the galvanizing tank and a steel strip travelling horizontally between the vertical pair of anode plates in a direction at right angles to the travelling direction of the steel strip (hereinafter the flow velocity of the electro-galvanizing bath shall mean the above-mentioned flow velocity).

Conditions for this test ware as follows:

Test conditions for marks "o" in FIG. 2:

(a) Chemical composition of the acidic electro-galvanizing bath employed:

$ZnSO_4.7H_2O$ (zinc sulfate): 500 g/l, $Na_2SO_4$ (sodium sulfate): 50 g/l, $CH_3COONa$ (sodium acetate ): 12 g/l, $CoSO_4$ (cobalt sulfate): 5 g/l as converted into metallic Co, $CrSO_4$ (chromiun sulfate): 0.5 g/l as converted into metallic Cr;

(b) Electro-galvanizing conditions:

Galvanizing current density: 40 $A/dm^2$,

Bath temperature: 50° C., pH value: 4.0,

Target weight of galvanized layer: 40 $g/m^2$.

Test conditions for marks "Δ" in FIG. 2:

Conditions identical with those for marks "o" mentioned above, except for a galvanizing current density of 30 $A/dm^2$.

Test conditions for marks "•" in FIG. 2:

Conditions identical with those for marks "o" mentioned above, except for addition of 15 g/l $CoSO_4$ as converted into metallic Co and a galvanizing current density of 40 $A/dm^2$.

Test conditions for marks " ▲ " in FIG. 2:

Conditions identical with those for marks "o" mentioned above, except for addition of 15 g/l $CoSO_4$ as converted into metallic Co and a galvanizing current density of 30 $A/dm^2$.

As is evident from FIG. 2, in the case with a Co content of within the range of the present invention (marks • and ▲ ), at a flow velocity of under 0.35 m/sec, the Co content of the electro-galvanized layer largely varies with the change of the galvanizing current density. However, at a flow velocity of the electro galvanizing bath of at least 0.35 m/sec, the Co tentent of the electro-galvanized layer is kept almost constant even if the galvanizing current density changes.

The above-mentioned phenomenon is considered to be caused by the fact that the thickness of the diffusion layer on the electro-deposition interface of the steel strip varies with change of the flow velocity of the electro-galvanizing bath. More specifically, a higher flow velocity of the electro-galvanizing bath leads to a thinner thickness of the diffusion layer on the electro-deposition interface of the steel strip and sufficient movement of such ions as $Zn^{2+}$, $H^+$ and $Co^{2+}$ to the electro-deposition interface, thus allowing normal electro-deposition and hence a constant Co content. At a lower flow velocity of the electro-galvanizing bath, on the other hand, the thickness of the diffusion layer on the electro-deposition interface becomes thicker and the movement of $Zn^{2+}$, $H^+$ and $Co^{2+}$ ions to the electro-deposition interface becomes slower, thus causing the galvanizing current density to vary, and hence the Co content to change.

With a flow velocity of the electro-galvanizing bath of under 0.35 m/sec, a higher galvanizing current density results in an increased Co content of the electro-galvanized layer, blackens the external appearance of the electro-galvanized layer, and thus impairs the commercial value of the electro-galvanized steel strip.

(2) Co:

Co has the effect of the improving bare corrosion resistance, and for obtaining this effect, it is necessary that the Co content of the electro-galvanized layer should be at least 0.3%. With a Co content of the electro-galvanized layer of over 1.0%, however, a further improvement in bare corrosion resistance cannot be expected, and moreover, addition of Co so as to give a Co content over 1.0% is not only uneconomical but also impairs the commercial value of the electro-galvanized steel strip by blackening the surface of the electro-galvanized layer.

Figure 3:
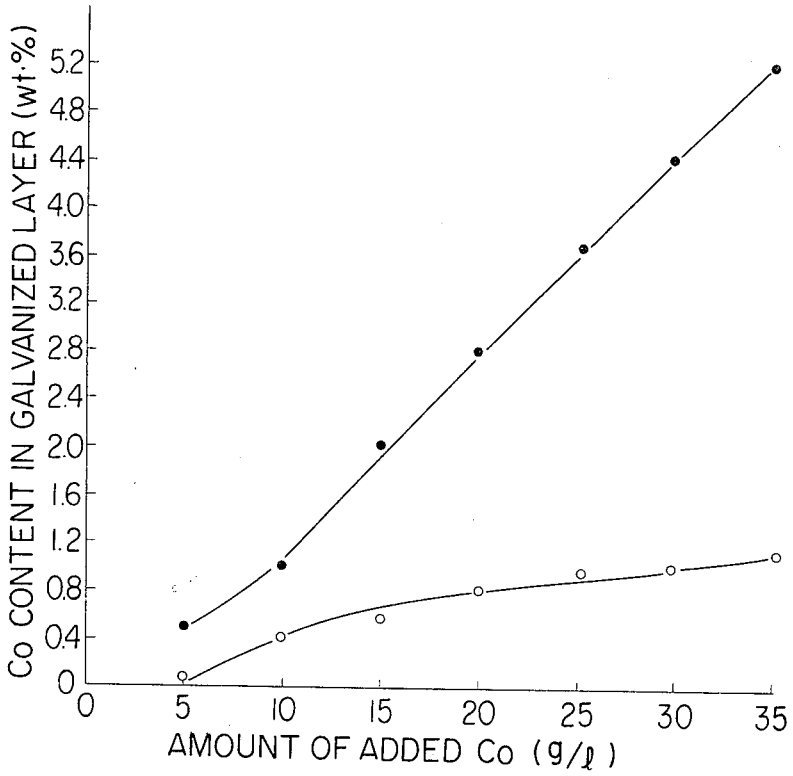
FIG. 3 is a drawing illustrating the relationship between the amount of Co added to the electro-galvanizing bath and the Co content of the electro-galvanized layer.

FIG. 3 shows the relationship between the amount of Co added to the electro-galvanizing bath and the Co content of the electro-galvanized layer.

Conditions for this test were as follows:

Test conditions for marks "o" in FIG. 3":

(a) Chemical composition of the acidic electro-galvanizing bath employed:

$ZnSO_4.7H_2O$ (zinc sulfate): 500 g/l, $Na_2SO_4$ (sodium sulfate): 50 g/l, $CH_3COONa$ (sodium acetate): 12 g/l, $CrSO_4$ (chromium sulfate): 0.4 g/l as converted into metallic Cr, $CoSO_4$ (cobalt sulfate): from 5 to 35 g/l as converted into metallic Co;

(b) Electro-galvanizing conditions:

Galvanizing current density: 20 A/dm$^2$,

Bath temperature: 50° C., pH value: 4.0,

Flow velocity of electro-galvanizing bath: 0.5 m/sec,

Target weight of electro-galvanized layer: 40 g/m$^2$.

Test conditions for marks "•" in FIG. 3:

Conditions identical with those for marks "o" mentioned above, except for a flow velocity of the electro-galvanizing bath of 0.1 m/sec.

As is clear from FIG. 3, with a flow velocity of the electro-galvanizing bath of 0.5 m/sec within the range of the present invention, the Co content of the electro-galvanized layer does not vary largely even if the amount of added Co varies from 8 to 30 g/l as converted into metallic Co, i.e., an amount of added Co of 30 g/l as converted into metallic Co leads to a Co content of the electro-galvanized layer of 1.0%, and an amount of added Co of 8 g/l as converted into metallic Co results in a Co content of the electro-galvanized layer of 0.3%. In the case of a flow velocity of the electro-galvanizing bath of 0.1 m/sec, in contrast, a change of the amount of added Co results in a large variation of the Co content of the electro-galvanized layer.

In the electro-galvanizing bath of the present invention, it is desirable to use any of such water-soluble compounds as cobalt sulfate, cobalt chloride and cobalt acetate as the Co additive.

(3) Cr:

It is estimated that Cr is chemically absorbed into the electro-galvanized layer of an electro-galvanized steel sheet in the form of Cr oxides and/or hydroxides, which form the nucleus for forming a chromate film and accelerate the growth of the chromate film. In addition, by causing Cr oxides and/or hydroxides and Co to coexist in the electro-galvanized layer, bare corrosion resistance of the electro-galvanized steel sheet is further improved, whereas, with an amount of added Cr of under 0.1 g/l as converted into metallic Cr, the above-mentioned effect is not accomplished sufficiently. When Cr is added in an amount of over 1.5 g/l as converted into metallic Cr, on the other hand, no further improvement can be expected in the above-mentioned effect: this is not only uneconomical, but also such inconveniences are encountered as production of precipitates in the electro-galvanizing bath and impossibility to obtain an electro-galvanized layer excellent in paint adhesion.

In the electro-galvanizing bath of the present invention, it is desirable to use such water-soluble compounds as chromium sulfate, chromium nitrate and dichromic acid as the Cr additive.

(4) Temperature of electro-galvanizing bath:

It is generally known that the temperature of the electro-galvanizing bath affects the Co content of the electro-galvanized layer. With this in view, we investigated the relationship between the temperature of the electro-galvanizing bath and the Co content of the electro-galvanized layer.

Figure 4:
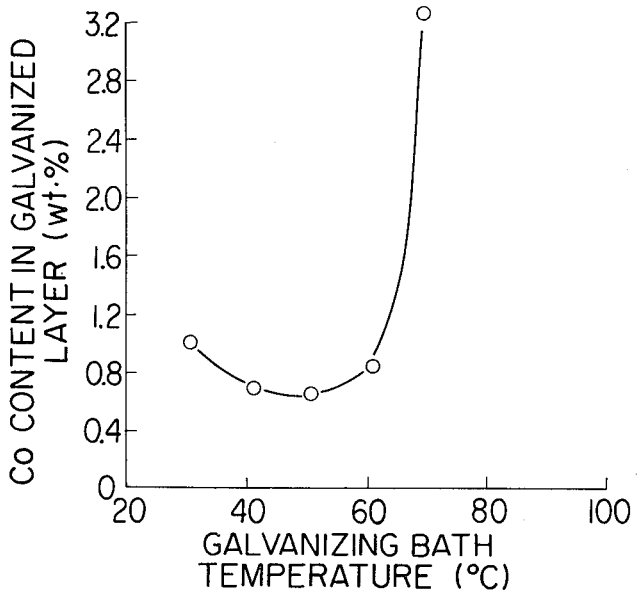
FIG. 4 is a drawing illustrating the relationship between the temperature of the electro-galvanizing bath and the Co content of the electro-galvanized layer.

FIG. 4 shows the relationship between the temperature of the electro-galvanizing bath and the Co content of the electro-galvanized layer.

Conditions for this test were as follows:

(a) Chemical composition of the acidic electro-galvanizing bath employed:

$ZnSO_4.7H_2O$ (zinc sulfate): 500 g/l, $Na_2SO_4$ (sodium sulfate): 50 g/l, $CH_3COONa$ (sodium acetate): 12 g/l, $CoSO_4$ (cobalt sulfate): 15 g/l as converted into metallic Co, $CrSO_4$ (chromium sulfate): 0.4 g/l as converted into metallic Cr;

(b) Electro-galvanizing conditions:

Flow velocity of electro-galvanizing bath: 0.4 m/sec, pH value: 4.0,

Galvanizing current density: 30 A/dm$^2$,

Target weight of electro-galvanized layer: 40 g/m$^2$.

As is evident from FIG. 4, with a flow velocity of the electro-galvanizing bath of 0.4 m/sec within the range of the present invention, no large variation occurs in the Co content of the electro-galvanized layer even at a change of the bath temperature within the range of the bath temperature of from 35° to 60° C.

In addition, we investigated the relationship between the galvanizing current density and the Co content of the electro-galvanized layer in the case where the bath temperature was altered. The results are represented in FIG. 5.

Figure 5:
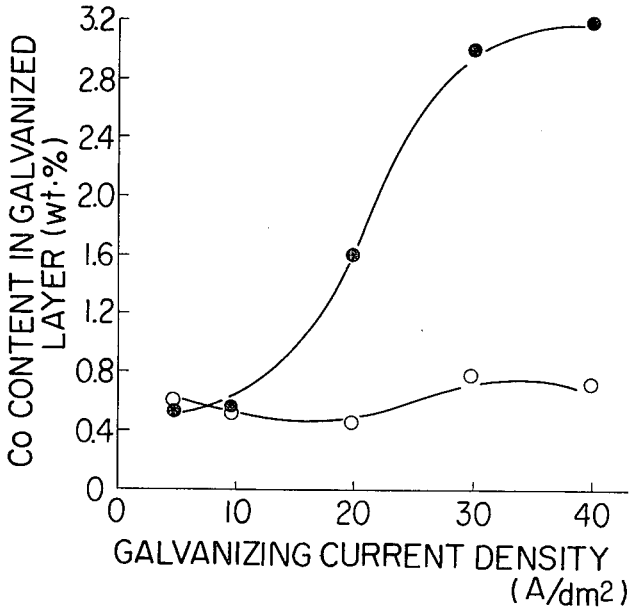
FIG. 5 is a drawing illustrating the relationship between the galvanizing current density and the Co content of the electro-galvanized layer.

Conditions for this test were as follows:

The conditions of test for marks "o" in FIG. 5:

(a) Chemical composition of the acidic electro-galvanizing bath employed:

$ZnSO_4.7H_2O$ (zinc sulfate): 500 g/l, $Na_2SO_4$ (sodium sulfate): 50 g/l, $CH_3COONa$ (sodium acetate): 12 g/l, $CoSO_4$ (cobalt sulfate): 15 g/l as converted into metallic Co, $CrSO_4$ (chromium sulfate): 0.4 g/l as converted into metallic Cr;

(b) Electro-galvanizing conditions:

Flow velocity of electro-galvanizing bath: 0.4 m/sec, pH value: 3.8,

Bath temperature: 50° C.,

Target weight of electro-galvanized layer: 40 g/cm$^2$.

Test conditions for marks "•" in FIG. 5:

Conditions identical with those for marks "o" mentioned above, except for a bath temperature of 70° C.

As is clear from FIG. 5, with a bath temperature of 50° C., a change of the galvanizing current density leads to no large variation of the Co content, as compared with the case of a bath temperature of 70° C.

Now, the process for manufacturing an electro-galvanized steel sheet of the present invention is described with reference to the drawings.

Figure 6:
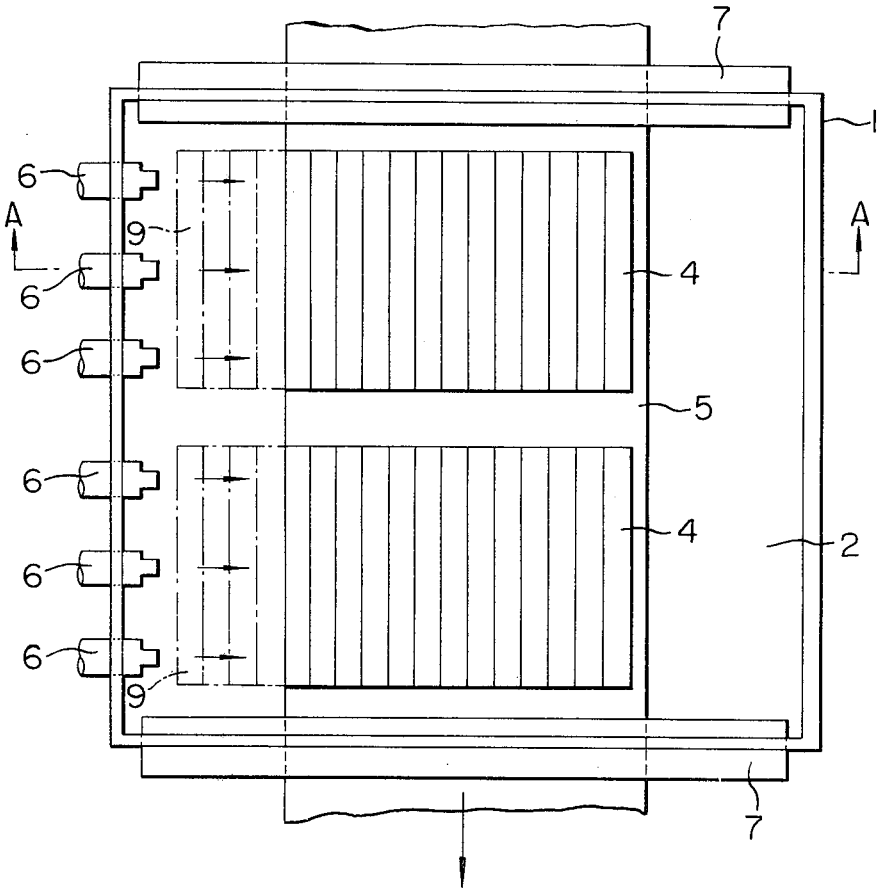
FIG. 6 is a schematic plan view illustrating an embodiment of the process of the present invention; and, FIG. 7 is a cross-sectional view of FIG. 6 cut along the line A—A.
Figure 7:
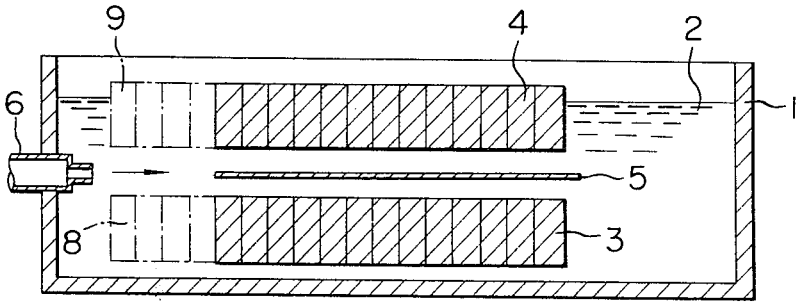

FIG. 6 is a schematic plan view illustrating an embodiment of the process of the present invention; and FIG. 7 is a cross-sectional view of FIG. 6 cut along the line A—A. In FIGS. 6 and 7, 1 is a galvanizing tank containing an electro-galvanizing bath 2; 3 is a lower anode plate horizontally installed at the lower part of the galvanizing tank 1; 4 is an upper anode plate installed in parallel with said lower anode plate 3 above said lower anode plate 3; 5 is a steel strip travelling horizontally between said lower anode plate 3 and said upper anode plate 4; 6 are a plurality of nozzles provided on a side wall of the galvanizing tank 1 with the orifices thereof directed toward the ends of said anode plates 3 and 4 in the galvanizing tank 1 and spaced apart from each other in the travelling direction of the steel strip; and, 7 are sealing rolls provided on the side walls of the entry side and exit side for the steel strip 5 of the galvanizing tank 1.

A flow of the electro-galvanizing bath is produced in the width direction of the steel strip 5 between the lower anode plate 3 and the upper anode plate 4 by the electro-galvanizing bath ejected from the nozzles 6, and the steel strip 5 travels through the galvanizing tank 1 across said flow of the electro-galvanizing bath. Because the electro-galvanizing bath 2 in the galvanizing tank 1 overflows from the galvanizing tank 1, the electro-galvanizing bath is always contained in the galvanizing tank 1 in a constant quantity. The process of the present invention specifies a flow velocity of the electro-galvanizing bath flowing in the width direction of the steel strip 5 between the lower anode plate 3 and the upper anode plate 4 of at least 0.35 m/sec. When the orifices of the nozzles 6 are more spaced apart from the lower anode plate 3 and the upper anode plate 4, the electro-galvanizing bath ejected from the nozzles 6 involves the surrounding electro-galvanizing bath and, therefore, even if a very high flow velocity of the electro-galvanizing bath is observed near the orifices of the nozzles 6, thus a large damping of the flow velocity of the electro-galvanizing bath is caused between the lower anode plate 3 and the upper anode plate 4. Also when the nozzles 6 are widely spaced apart from each other, the flow velocity of the electro-galvanizing bath is reduced at intervals between adjacent nozzles 6.

In order to prevent damping of the flow velocity of the electro-galvanizing bath, it suffices to increase the ejecting flow velocity of the electro-galvanizing bath from the nozzles 6, or bring the tip of the nozzles 6 closer to the edge side of the steel strip 5. However, as indicated by the one-point chain line in FIGS. 6 and 7, by fitting virtual plates 8 and 9, which extend horizontally toward the nozzle 6 side respectively, to the ends of the lower anode plate 3 and the upper anode plate 4 respectively on the nozzle 6 side, it is possible to prevent involvement of the surrounding electro-galvanizing bath caused by the electro-galvanizing bath ejected from the nozzles 6, and hence to prevent damping of the flow velocity of the electro-galvanizing bath, thus permitting saving of installation and operating costs.

Now, the present invention is further described by means of examples while comparing with references.

EXAMPLES

A steel strip was subjected to an electro-galvanizing treatment by changing the flow velocity of the electro-galvanizing bath flowing between the anode plates, the amounts of added Co and Cr, and the galvanizing current density, as shown in Table 1, under the following conditions:

(a) Chemical composition of the electro-galvanizing bath:

$ZnSO_4.7H_2O$: 500 g/l,
$Na_2SO_4$: 50 g/l,
$CH_3COONa$: 12 g/l;

(b) Electro-galvanizing conditions:

Bath temperature: 50° C.,
pH value: 4.0,
Target weight of electro-galvanized layer: 40 g/m$^2$.

TABLE 1

| | Flow velocity of electro-galvanizing bath (m/sec) | Galvanizing current density (A/dm$^2$) | Amount of added Co (g/l) | Amount of added Cr (g/l) |
|---|---|---|---|---|
| Example 1 | 0.4 | 30 | 15 | 0.5 |
| Example 2 | 0.4 | 30 | 20 | 0.5 |
| Example 3 | 0.8 | 30 | 15 | 1.0 |
| Example 4 | 0.8 | 30 | 20 | 1.0 |
| Example 5 | 1.0 | 30 | 15 | 0.8 |
| Example 6 | 1.0 | 30 | 20 | 0.8 |
| Example 7 | 1.5 | 30 | 15 | 1.2 |
| Example 8 | 1.5 | 30 | 20 | 1.2 |
| Example 9 | 0.8 | 40 | 15 | 1.0 |
| Example 10 | 0.8 | 20 | 20 | 1.0 |

Table 2 shows the results of measurement of the time up to occurrence to red rust in the salt spray test (i.e., bare corrosion resistance), as measured on electro-galvanized steel strips subjected only to an electro-galvanizing treatment, the external appearance of the electro-galvanized layer, and the time up to occurrence of red rust in the salt spray test after chromating (i.e., corrosion resistance after chromating), together with the Co content of the electro-galvanized layer as a result of the electro-galvanizing treatment shown in Table 1.

TABLE 2

| | Co content of electro-galvanized layer (wt. %) | Electro-galvanized steel strip: External appearance of electro-galvanized layer | Electro-galvanized steel strip: Time up to occurrence of red rust (hr) | Chromated electro-galvanized steel strip Time up to occurrence of red rust (hr) |
|---|---|---|---|---|
| Example 1 | 0.7 | Good | 120 | 240 min. |
| Example 2 | 0.8 | Good | 120 | 240 min. |
| Example 3 | 0.7 | Good | 120 | 240 min. |
| Example 4 | 0.8 | Good | 120 | 240 min. |
| Example 5 | 0.7 | Good | 120 | 240 min. |
| Example 6 | 0.8 | Good | 120 | 240 min. |
| Example 7 | 0.7 | Good | 120 | 240 min. |
| Example 8 | 0.8 | Good | 120 | 240 min. |
| Example 9 | 0.7 | Good | 120 | 240 min. |
| Example 10 | 0.7 | Good | 120 | 240 min. |

As is evident from Table 2, in the case of the Examples 1 to 10 of the present invention, the Co content of the electro-galvanized layer remains constant, depending upon the amount of added Co, irrespective of the change of the flow velocity of the electro-galvanizing bath, and the electro-galvanized steel strips subjected only to an electro-galvanizing treatment show a time up to occurrence of red rust longer than in the References 1 to 7 described later, an excellent bare corrosion resistance, and a good external appearance of the electro-galvanized layer surface. For those additionally subjected to a chromating treatment, the time up to occurrence of red rust after chromating is longer than those of the References described later, with a superior applicability of chromating. And also, Examples 3, 4, 9 and 10 demonstrate that a change of the galvanizing current density does not lead to a large variation of the Co content of the electro-galvanized layer.

Then, as shown in Table 3, steel strips were subjected to an electro-galvanizing treatment under the same conditions as those given in item (b) of the above-mentioned examples with the use of a pure-zinc galvanizing bath not containing Co nor Cr (References 1 and 2), an electro-galvanizing bath containing Co and Cr of which the contents are however outside the scope of the present invention (References 3 to 8), or an electro-galvanizing bath having a chemical composition within the range of the present invention, but flowing between the anode plates at a flow velocity outside the scope of the present invention (References 9 to 12).

TABLE 3

| | Flow velocity of electro-galvanizing bath (m/sec) | Galvanizing current density ($A/dm^2$) | Amount of added Co (g/l) | Amount of added Cr (g/l) |
|---|---|---|---|---|
| Reference 1 | 1.0 | 30 | — | — |
| Reference 2 | 0.4 | 30 | — | — |
| Reference 3 | 0.4 | 30 | 1 | 0.4 |
| Reference 4 | 0.4 | 30 | 3 | 0.5 |
| Reference 5 | 0.8 | 30 | 3 | 0.5 |
| Reference 6 | 1.0 | 30 | 3 | 0.5 |
| Reference 7 | 1.5 | 30 | 5 | 0.2 |
| Reference 8 | 1.0 | 30 | 50 | 0.8 |
| Reference 9 | 0.25 | 30 | 15 | 0.5 |
| Reference 10 | 0.25 | 30 | 20 | 0.8 |
| Reference 11 | 0.25 | 40 | 15 | 0.5 |
| Reference 12 | 0.25 | 20 | 20 | 0.8 |

Table 4 shows the resultant Co content of the electro-galvanized layer, the time up to occurrence of red rust in the salt spray test and external appearance of the electro-galvanized layer of the electro-galvanized steel strip subjected only to an electro-galvanizing treatment and the time up to occurrence of red rust in the salt spray test after chromating.

TABLE 4

| | Co content of electro-galvanized layer (wt. %) | Electro-galvanized steel strip: External appearance of electro-galvanized layer | Electro-galvanized steel strip: Time up to occurrence of red rust (hr) | Chromated electro-galvanized steel strip: Time up to occurrence of red rust (hr) |
|---|---|---|---|---|
| Reference 1 | 0 | Good | 48 | 144 |
| Reference 2 | 0 | Good | 48 | 144 |
| Reference 3 | 0.009 | Good | 48 | 120 |
| Reference 4 | 0.03 | Good | 60 | 168 |
| Reference 5 | 0.03 | Good | 60 | 144 |
| Reference 6 | 0.04 | Good | 60 | 168 |
| Reference 7 | 0.08 | Good | 60 | 168 |
| Reference 8 | 3.0 | Black (bad) | 144 | 144 |
| Reference 9 | 1.5 | Black (bad) | 168 | 168 |
| Reference 10 | 2.0 | Black (bad) | 144 | 144 |
| Reference 11 | 2.3 | Black (bad) | 168 | 168 |
| Reference 12 | 1.5 | Black (bad) | 144 | 144 |

As is evident from Table 4, in the References 1 and 2, although the electro-galvanized layer shows a good external appearance because of the complete absence of Co in the electro-galvanized layer, the time up to the occurrence of red rust of the electro-galvanized steel strip subjected only to an electro-galvanizing treatment is far shorter and hence bare corrosion resistance is inferior as compared with the Examples of the present invention. In the References 3 to 7, although the electro-galvanized layer shows a good external appearance because of the very low Co content of the electro-galvanized layer, the time up to the occurrence of red rust of the electro-galvanized steel strip subjected only to an electro-galvanizing treatment is far shorter and hence bare corrosion resistance is inferior as compared with the Examples of the present invention. In the References 8 to 10, the time up to the occurrence of red rust of the electro-galvanized steel strip subjected only to an electro-galvanizing treatment is longer than those of the Examples of the present invention because of the very high Co content of the electro-galvanized layer, but the external appearance of the electro-galvanized layer surface is bad with a blackened color. In all the References 1 to 12, the time up to occurrence of red rust after chromating is shorter than those of the Examples of the present invention, thus leading to an inferior chromating applicability. Furthermore, as is observed in the References 9 to 12, a change of the galvanizing current density results in a large variation of the Co content of the electro-galvanized layer even without a change of the flow velocity of the electro-galvanizing bath or in the amount of added Co or Cr.

Figures representing bare corrosion resistance of the electro-galvanized steel strip and susceptibility to red rust of the chromated electro-galvanized steel strip in Tables 2 and 4 are the results of measurement of the time up to the occurrence of red rust in the salt spray test based on the Japanese Industrial Standard (JIS) Z 2371.

According to the present invention, as described above in detail, the Co content of the electro-galvanized layer remains constant even at a change of the galvanizing current density caused by a change of the line speed or other conditions, and it is thus possible to prevent irregularities from occurring in the external appearance of the electro-galvanized layer and to manufacture an electro-galvanized layer showing a stable bare corrosion resistance and an excellent corrosion resistance after chromating treatment, thus providing industrially useful effects.

What is claimed is:

1. In a process for manufacturing an electro-galvanized steel strip, which comprises:

moving a steel strip in an acidic electro-galvanizing bath at a temperature within the range of from 35° C. to 60° C. containing cobalt and chromium in parallel with the plane of at least one anode plate and flowing said electro-galvanizing bath between said steel strip and said anode plate in a direction at right angles to the moving direction of said steel strip, and passing an electric current between said anode plate and said steel strip to provide an electro-galvanizing treatment, thereby forming, on at least one surface of said steel strip, an electro-galvanized layer having excellent bare corrosion resistance and excellent corrosion resistance after chromating;

the improvement characterized by:

keeping the cobalt content in said electro-galvanizing bath within the range of from 8 to 30 g/l, as converted into metallic cobalt, and the chromium content in said electro-galvanizing bath within the range of from 0.1 to 1.5 g/l, as converted into metallic chromium;

and, flowing said electro-galvanizing bath between said steel strip and said anode plate at a flow velocity of at least 0.35 m/sec.

* * * * *